US005472295A

United States Patent [19]

Ikeda et al.

[11] Patent Number: 5,472,295

[45] Date of Patent: Dec. 5, 1995

[54] SHIELD TUNNELING METHOD USING FLEXIBLE SEGMENTS, FLEXIBLE SEGMENTS FOR SHIELD TUNNELING METHOD, AND FLEXIBLE SEGMENTS FOR SECONDARY APPLICATION OF SHIELD TUNNELING METHOD

[75] Inventors: Shintaro Ikeda, Kusatsu; Michio Kitawaki, Kyoto, both of Japan

[73] Assignees: The Victaulic Company of Japan Limited, Tokyo; Mutsubishi Rubber Company Limited, Hyogo, both of Japan

[21] Appl. No.: 145,473

[22] Filed: Oct. 28, 1993

[30] Foreign Application Priority Data

Oct. 30, 1992 [JP] Japan ..... 4-314310
Nov. 27, 1992 [JP] Japan ..... 4-339441

[51] Int. Cl.[6] ..... E21D 5/08

[52] U.S. Cl. ..... 405/152; 405/151; 405/153

[58] Field of Search ..... 405/151, 152, 405/153, 136, 135, 134

[56] References Cited

U.S. PATENT DOCUMENTS 4,027,902 6/1977 Tanikawa ..... 405/135 X
4,730,427 3/1988 Tomsin ..... 405/151 X
5,295,764 3/1994 Cunat ..... 405/151

*Primary Examiner*—Dennis L. Taylor
*Attorney, Agent, or Firm*—Frishauf, Holtz, Goodman, Langer & Chick

[57] ABSTRACT

A general segment 20 which is propelled and set in an excavated hole by a propulsion excavating machine, and a flexible segment where flexible members 4 and rigid ring members are alternately installed and connected inside the skin-plate 7 provided on the outer periphery side of the side rings 5 having the same thickness as the general segment and a thrust-receiving member 9 is provided inside the flexible portion, are propelled and set by the propulsion excavating machine and then secondary coating concrete 30 including a secondary watertight band 15 is applied to said side ring. As a segment for a shield tunneling method, the flexible segment appropriately provides flexibility to quickly cope with earthquakes and uneven settlement. The flexible segment may be handled in the same manner as a standard general segment during excavation work, providing excellent application potential. Furthermore, the elastic and resilient members to provide flexibility are stably secured to connection ring members at both ends, preventing peeling from occurring, and at the same time, generating minimal unreasonable stress, thereby allowing application of excellent durability to be obtained.

27 Claims, 7 Drawing Sheets

SHIELD TUNNELING METHOD USING FLEXIBLE SEGMENTS, FLEXIBLE SEGMENTS FOR SHIELD TUNNELING METHOD, AND FLEXIBLE SEGMENTS FOR SECONDARY APPLICATION OF SHIELD TUNNELING METHOD

FIELD OF THE INVENTION

The present invention relates to a shield tunneling method using flexible segments and to flexible segments for a shield tunneling method. More particularly, this invention relates to a mechanism for a shield tunneling method and segments thereof which quickly and effectively copes with earthquakes or uneven settlement, exhibits sufficient watertightness as well as elasticity/flexibility, is easily applied and handled, eliminates the generation of stress, and has excellent durability.

BACKGROUND OF THE INVENTION

The shield tunneling method plays an important role in civil engineering works. Providing segments with flexibility is essential to avoid damage to shield segments per se and to ensure safety in weak ground in the event of uneven settlement or earthquake. Various investigations have been carried out in this area thus far. In general, such flexible segments are installed in the shell of a shield machine and are set by means of thrust application together with general segments, then load-bearing members and sealing members are installed on the inner surfaces of these flexible and general segments for application of a secondary concrete coating on the inner surfaces of said general segments.

An application example of such a flexible segment is shown in FIG. 10. The primary application member 50, consisting of frame members 21 and 21, which also serve as secondary coating, and thrust-receiving member 22, is installed with an erector, etc., in the row of general segments 20, which are standard members, in the shell 51 of a shield machine, and thrust excavation application is then performed in which thrust from the shield machine acts on the general segments 20 and the primary application member 50.

On completion of thrust transmission with the thrust application performed in the above manner, said thrust-receiving member 22 is removed, a flexible, secondary watertight member 22 is installed as shown in FIG. 11, and at the same time, the cover cloth 25, load-bearing member 26, and load-bearing sleeve 27 are also installed, and secondary coating 23 is applied to the anchor 28 as shown in FIG. 12.

With conventional methods such as that described above, the structure and handling are complicated, requiring a substantial number of man-hours in the field. To be more precise, in the states shown in FIGS. 10 and 12, the frame member 21 is the only member that remains the same between general segments 20, and the other members and the structural relationships are totally different. With such a configuration, each segment or member is removed sequentially and another segment or member is installed on the entire periphery of the excavated hole formed with a circular cross-sectional shape. This inevitably requires a substantial number of man-hours.

Furthermore, since frame members which are considerably thicker than general segments 20 are used in the primary application, their handling during assembly is extremely different from that of standard, general segments, making the work complicated. The main members such as the thrust-receiving member, which are installed and connected together during thrust application as shown in FIGS. 10 and 11, are removed and completely separated and then new, separate members are installed. The watertight linkage and sealing which is established during thrust application is lost through the handling of the new members, and new linkage and sealing is established when new members are installed. Therefore, appropriate watertightness and stress distribution are difficult to obtain.

DISCLOSURE OF THE INVENTION

In the present invention, extensive investigation was carried out to eliminate the problems of the prior art as described above. By integrating a rigid member with a specific elastic member, a segment has been obtained which ensures effective thrust transmission and watertight functions during thrust application and the subsequent secondary coating application, with the same shape and dimension ranges as those of a general segment, as follows.

A general segment which is propelled and set in an excavated hole by receiving thrust from a propulsion excavating mechanism, and a flexible segment where a thrust-receiving member is arranged inside the flexible portion formed by installing and connecting flexible members and rigid connection ring members alternately inside the skin-plate provided on the outer periphery side between the side ring members having substantially the same thickness as the general segment, are propelled and set by said propulsion excavating mechanism and then a secondary concrete coating including a secondary watertight band is applied to said side ring members. In this way, a shield tunneling method using flexible segments is executed easily and promptly and stable flexible shielding is formed.

Said thrust setting is performed with a thrust excavating mechanism and then only said thrust-receiving member is removed and secondary coating concrete including a secondary watertight band is applied to said side ring members. In this way, the thrust-receiving member is reused, and furthermore, stable flexible shielding is formed easily and effectively.

A primary application general segment which is propelled and set in an excavated hole by receiving thrust from a propulsion excavating mechanism, and a primary application segment with first flexible members where a thrust-receiving member is arranged inside the flexible portion formed by installing flexible members and rigid connection ring members alternately inside the skin-plate provided on the outer periphery side between the first side ring members having substantially the same thickness as the primary application general segment, are propelled and applied with said propulsion excavating mechanism, then second side ring members having substantially the same width as the thickness of the secondary application general segment are connected and installed opposite said first side ring members, a secondary application segment made by connecting plate-shaped second connection ring members and second flexible members having bendable portions is provided between the second side ring members, and said secondary application general segment is also provided. In this way, strong shielding having appropriate flexibility is formed easily and accurately by means of thrust application with the primary application general segment and the primary application segment having a flexible portion made of first flexible members and by means of the secondary application segment using second flexible members.

Side ring members are installed opposite each other having substantially the same thickness as the general segment which is propelled and set in an excavated hole by receiving thrust from a propulsion excavating mechanism. In this way, flexible members are installed through these side ring members and all of the flexible members installed through the side ring members are handled in the same manner as the general segments to perform thrust application.

Side ring members are installed opposite each other, having substantially the same thickness as the general segment which is propelled and set in an excavated hole by receiving thrust from a propulsion excavating mechanism, an inverted "V"-shaped bend is formed in the middle in the outer peripheral direction inside the skin-plate provided on the outer periphery side between the side ring members, flexible members having parallel joint end faces are provided at both ends of the inverted "V"-shaped bend, a flexible portion is configured by installing and connecting the flexible members having joint end faces connected to said end plates, and rigid connection rings alternately, and a thrust-receiving member is arranged inside the flexible portion. In this way, a flexible segment for a flexible shield tunneling method suitable for thrust excavation application is obtained.

An inverted "V"-shaped bend is formed in the middle in the outer peripheral direction inside the skin-plate provided on the outer periphery side at each of said side ring members and a flexible portion having parallel joint end face portions at both ends of the inverted "V"-shaped bend by folding it back by an equal thickness is provided. In this way, the joint end face portions are installed and secured with the end plates of the connection ring members and the retainer plates.

A flexible portion is configured by installing and alternately connecting several connection ring members and flexible members installed by securing them with the end plates of the connection ring members and the retainer plates at the ends as described above. In this way, a balanced setting relationship with wide joint end faces is established under the condition where intrusion of external soil and sand is prevented by the skin-plate. Also, the flexible members and the connection ring members under the condition where no biased action exists, link together stably to allow resilient thrust action even at the flexible member portions.

A thrust-receiving member is arranged inside the flexible portion consisting of a combination of the flexible members and connection ring members described above. Thus, the same thrust transmission as with the general segment is attained in the same thickness range as the general segment.

Because the end plates and the retainer plates are installed to both ends of the flexible members formed of rubber, etc., as described above, the flexible portion has characteristics similar to a rigid body at both its ends, strengthens and stabilizes connection to the connection ring members providing sufficient flexibility and bending action and eliminating peeling at said both ends, thus providing a flexible segment having high durability.

The thrust-receiving member arranged inside the flexible portion is provided so as to be removable from the side ring members. The thrust-receiving member is removed after thrust application. Secondary coating frames are installed while the flexible portion is left as it is. Because the flexible portion is retained while thrust application is in progress, a stable setting relationship is maintained. This, coupled with the fact that the joint end faces of the flexible members are secured with the end plates and the retainer plates, means little biased stress is generated and accurate sealing is achieved, and the seal is maintained for an extended period of time, providing a mechanism of excellent durability.

The flexible member is set in a state where it receives compressive force because the set dimension is smaller than the forming dimension and is still in a state of compression smaller than the forming dimension even when elongation is absorbed. Because the flexible member is installed so that substantially no tensile force is exerted, tensile stress is not generated in the flexible member made of rubber etc., eliminating peeling, etc., and thus providing a segment of high durability.

The thrust-receiving member arranged inside the flexible portion is provided with a connection bolt so as to be removable from the side rings and said thrust-receiving member may be removed at any appropriate time. Thus, the removal of the thrust-receiving member is facilitated after thrust excavation application.

Side ring members are installed opposite each other, having substantially the same thickness as the general segment which is propelled and set in an excavated hole by receiving thrust from a propulsion excavating mechanism, an inverted "V"-shaped bend is formed in the middle in the outer peripheral direction inside the skin-plate provided on the outer periphery side between the side ring members, parallel joint end face portions are formed on both sides of the inverted "V"-shaped bend by folding it back, and a flexible portion is configured by installing and alternately connecting several connection ring members and flexible members where the end plates of the connection ring members and the retainer plates are provided so that the joint end face portions are placed between them and secured. In this way, a flexible shield member is formed in which the flexible members and the connection ring members are connected stably and strongly.

Because the inverted "V"-shaped bend of the flexible member and the joint end faces formed integrally with it at both its ends are formed to have substantially equal thicknesses, stable flexible action is achieved and a flexible member of high durability is obtained.

The flexible member is set in a state where it is smaller than the forming dimension and receives compressive force and is still in a state of compression smaller than the forming dimension even when elongation is absorbed, and the flexible member is installed so that substantially no tensile force is exerted. In this way, deterioration of the resilient action, which is caused by placing the flexible member in an elongated state, of the flexible member formed with rubber is prevented, ensuring flexible action of high durability in underground structures.

A connection ring member is formed with end plates, outer plate, and receptor plates installed on the inner diameter side of said end plates, and the receptor plates support the folded-back portions of the flexible member. Thus, the flexible member and connection ring member are set in an effectively bonded state, appropriately providing flexible and elastic action at all times and preventing the flexible member from deformation and damage.

The width of the joint end faces formed on both sides of the flexible member by folding it back is equal to 50–70% of the width of the end plates of the connection ring member. Thus, both ends of the flexible members are joined with the end plates of the connection ring members in a stable state during assembly, allowing the bending and flexible action of the flexible members to be obtained effectively and appropriately.

The forming dimension or width of the flexible member is larger than the setting dimension or width of the flexible member and the flexible member is set in a state of compression both at regular assembly dimension and when elongation is absorbed. Thus, stable setting is obtained and flexible shielding of excellent durability is obtained.

An inverted "V"-shaped bend is formed in the middle in the outer peripheral direction inside the skin-plate provided on the outer periphery side between the side ring members described above, parallel joint end face portions are formed on both sides of the inverted "V"-shaped bend by folding it back, a flexible portion is configured by alternately installing and connecting several connection ring members and flexible members where the end plates of the connection ring members and the retainer plates are provided so that the joint end face portions are placed between them and secured, and furthermore, secondary watertight bands are installed between said respective side rings. In this way, secondary coating frames are installed with side ring members having substantially the same width as the thickness of the general segment. Thus, flexible shielding in which secondary coating is also adopted is formed easily.

The secondary watertight band has, in the axial direction, additional pieces having reinforcements of cross-sectional letter "L" shape on the outer surface of the sealing member having sealing portions at both ends and also has additional plates curved on the inner surface in the circumferential direction, and by engaging the respective ends of these additional plates to the pawls and with the resilience of the additional plates per se, said sealing member is pressed against the seal ring. In this way, the removal operation of the secondary watertight bands is facilitated and stable and accurate setting of the sealing state is achieved.

An inverted "V"-shaped bend is formed in the middle in the outer peripheral direction inside the skin-plate provided on the outer periphery side between the side ring members described above, parallel joint end face portions are formed on both sides of the inverted "V"-shaped bend by folding it back, a flexible portion is configured by installing and alternately connecting several connection ring members and flexible members where the end plates of the connection ring members and the retainer plates are provided so that the joint end face portions are placed between them and secured, and furthermore, secondary coating frames are internally installed between said respective side rings, a skin-plate is installed on the inner periphery between these secondary coating frames, and said flexible portion is installed in an inverted state on the outer periphery side of said skin-plate. In this way, flexible shielding in which secondary coating is adopted is effectively executed under balanced setting conditions.

Because secondary concrete coating is formed on the inner periphery side of the general segments located on both sides of the secondary coating frames, high strength shielding in which secondary coating is adopted is formed effectively and easily.

The flexible segment comprises a primary application segment where first side ring members are installed opposite each other of substantially the same thickness as the primary application general segment which is propelled and set in an excavated hole by receiving thrust from a propulsion excavating mechanism, an inverted "V"-shaped bend is formed in the middle in the outer peripheral direction inside the skin-plate provided on the outer periphery side between the first side ring members, parallel joint end face portions are formed on both sides of the inverted "V"-shaped bend by folding it back by an equal thickness, a flexible portion is configured by installing and alternately connecting several first connection ring members and first flexible members where the end plates of the first connection ring members and the retainer plates are provided so that the joint end face portions are placed between them and secured, and a secondary application segment where second side ring members having substantially the same width as the thickness of the secondary application general segment provided inside said primary application segment are installed opposite each other by connecting them to said first side ring members and several plate-shaped second connection ring members and second flexible members having bendable portions in the middle are connected between these second side ring members. In this way, flexible shielding of excellent strength is formed effectively due to the bondage of the primary and secondary application segments.

A projection which accepts and supports an end of the second flexible member is formed at the middle of the plate-shaped second connection ring member, the ends of the second flexible member are set in the projection and the plate-shaped second connection ring member and are secured with a retainer plate whose width is in the direction orthogonal to said projection. In this way, a stable, accurate setting and installing relationship between the second flexible member and the second connection ring member is achieved and the strength of the plate-shaped second connection ring member is improved.

As described above, the segment for a shield tunneling method of the present invention provides appropriate flexibility to quickly cope with earthquakes or uneven settlement. It has a simple configuration and may be handled in exactly the same manner as the standard general segment during excavation application. It consists of a small number of parts and has excellent application potential. Furthermore, the elastic and resilient members to provide flexibility are stably secured to connection ring members at both ends, preventing peeling from occurring, and at the same time, generating minimal unreasonable stress, thereby allowing applications of excellent durability to be obtained.

As a segment for secondary application of the shield tunneling method, the segment provides appropriate flexibility to quickly cope with earthquakes or uneven settlement. In addition, the elastic and resilient members to provide flexibility are stably secured to connection ring members at both ends, in both primary application and secondary application segments, preventing peeling from occurring, and at the same time, generating minimal unreasonable stress, thereby allowing application of excellent durability to be obtained. Furthermore, sufficient space may be obtained for various members, piping, and wiring between the primary application segment and the secondary application segment.

PREFERRED EMBODIMENTS OF THE INVENTION

Figure 1:
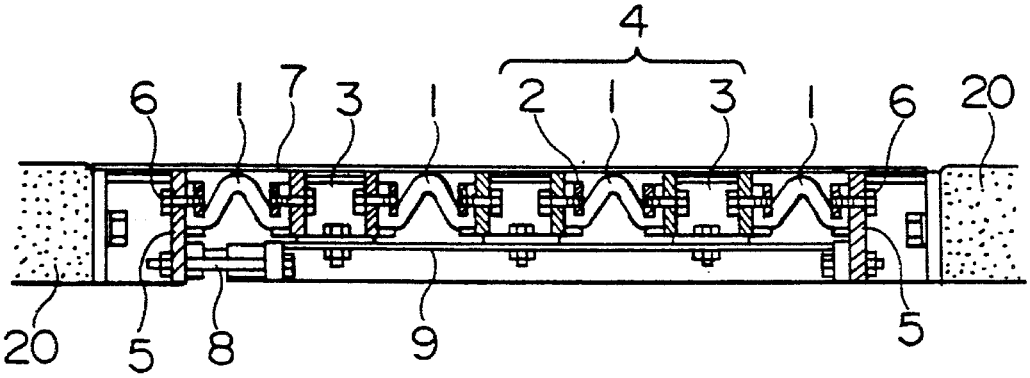
FIG. 1 is a cross-sectional drawing of the flexible segment of the present invention in the state of the primary application.

The preferred embodiments of the present invention are described below, referring to the accompanying drawings. The flexible segment of the present invention at the time of primary processing, which is installed between general segments 20 and 20 and is subject to thrust application, is as shown in FIG. 1. A skin-plate 7 is installed on the outer surfaces of the side rings 5 and 5 so that the flexible segment has the same width as the general segment 20. The height of the side rings 5 and 5 (i.e., thickness of the segment) matches the dimension of the general segment 20.

Figure 2:
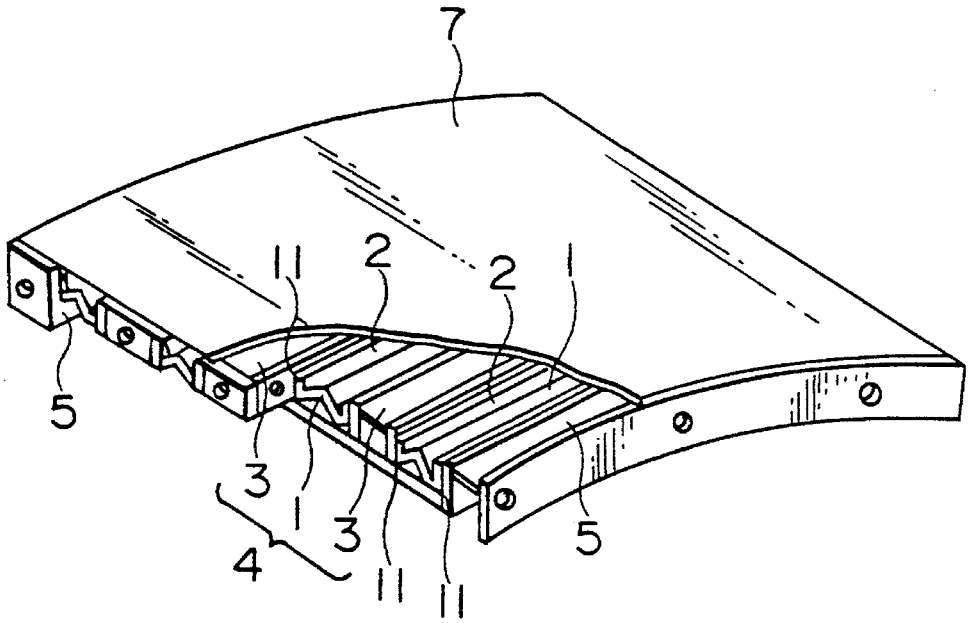
FIG. 2 is a drawing of the flexible segment of the present invention in an assembled state in the primary application, as viewed obliquely, with a cutaway portion being shown.

As shown in FIG. 2, said skin-plate 7 is positioned on the outer surface of the flexible portion 4 where several flexible members 1 and connection ring members 3 are installed alternately and connected with the connectors 6. Joint end faces 11 of equal thickness are formed at both ends of a flexible member 1 made of rubber. As shown separately in FIG. 3, a connection ring member 3 is formed with said end plates 3*a* and 3*a*, outer plate 3*b*, and receptor plates 31 installed on the inner diameter side of the end plates 3*a*.

With the present invention, the cross-sectional structure of said flexible member 1 has important characteristics. It has an appropriate thickness with its center portion being bent like an inverted "V" and has elasticity in the width direction. The joint end faces 11 located at both ends of the flexible member 1 to be connected to end plates 3*a* are formed having a uniform thickness by folding the member back from said inverted "V"-shaped bend. The joint end faces 11 and 11 are made parallel to each other. A connection ring member 3 is tightened securely with the connectors 6 at the end faces 3*a* and the retainer plates 2.

Providing said flexible member 1 with a reasonable thickness is the basic reason for favorable thrust transmission being attained with flexible portion 4 using such flexible members 1 shown in FIG. 2. Favorable design conditions are that it has a reasonable thickness even at the middle bend in relation to the width (height in the figure) of the end plates 3*a*, and in relation to the thickness of such middle bend, the width of the joint end faces 11 and 11 should be approximately 40 to 65% of the width of the end plates 3*a*. Under these conditions, favorable resilient thrust action may be attained with the rubber flexible member 1 when thrust force is received.

The height of the above flexible member 1 and the connection ring member 3 in the inside to outside direction should be 50 to 70%, or preferably about 60%, of the height of said side rings 5 and 5. A thrust-receiving member 9 is installed on the inner surfaces of the side rings 5 and 5 where these members 1 and 3 are installed on the skin-plate 7 side. The side rings 5 and 5 and the thrust-receiving bolt 8 are installed to ensure the transmission of thrust from the pusher of an excavator, etc.

The flexible portion 4 described above is generally produced and assembled at a factory. The form of the flexible portion at the time of shipment is as shown separately in FIG. 2 (with a cutaway portion shown). The width and the thickness of the flexible portion (including the side ring 5) are the same as those of the general segment 20. For example, by setting the width to 900 mm and the thickness to 250 mm, the flexible portion may be shipped and handled in exactly the same manner as said general segment 20 having standard dimensions. Thrust transmission is accomplished exactly with rigid transmission with the thrust-receiving bar and thrust-receiving bolt 8 on the inner surface and with resilient transmission with the flexible portion 4 that is both resilient and free from biased action force.

Figure 4:
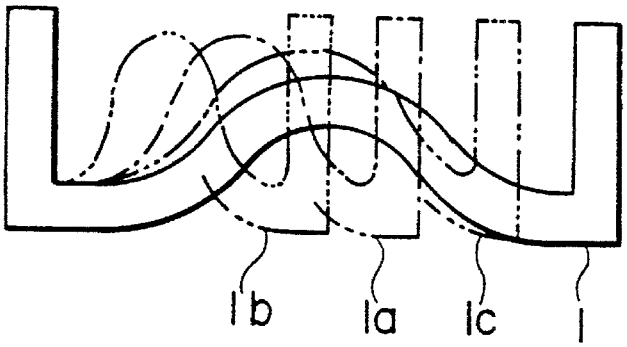
FIG. 4 is an explanatory drawing of cross-sectional deformation, showing the flexible member of the primary application segment of the present invention, both in the formed state (natural state where restriction is removed) and in the assembled and expanded/contracted state.

The forming dimensions of the flexible member 1 made of rubber, etc., (i.e., dimensions in its natural state) are as indicated by the solid line in FIG. 4. This flexible member does not exert tensile force and is always set in a state to receive compressive force. The state 1*a* shown with the corresponding imaginary line in FIG. 4 represents the regular assembly dimensions at which the flexible member is compressed and set as described above. The state 1*b* shown with the corresponding imaginary line is the state where shrinkage is absorbed. The state 1*c* is when elongation is absorbed. Even when elongation is absorbed, the flexible member is in a state of compression which is smaller than the forming dimensions. By virtually eliminating the exertion of tensile force, the joint end faces 11 and 11 may be prevented from damage and peeling due to tensile force.

Figure 3:
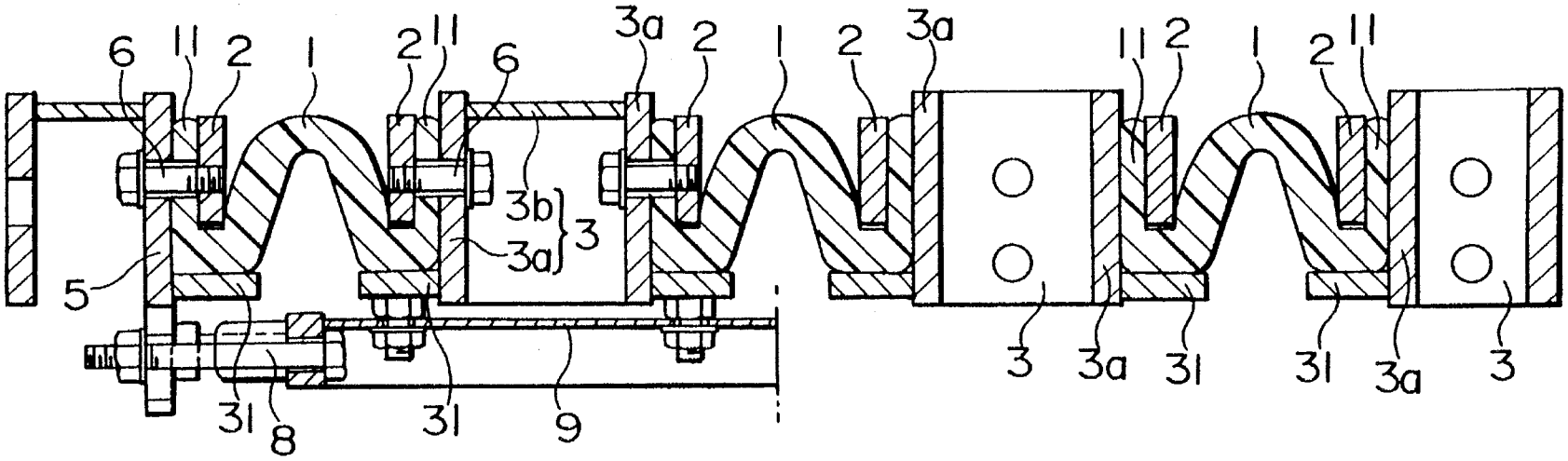
FIG. 3 is a cross-sectional drawing showing the connections in the flexible portion of the primary application segment of the present invention.

At the time when the effect of thrust on the segments which are subject to primary application as shown in FIG. 1 is lost, if the thrust-receiving bolt 8 shown in FIG. 3 is loosened and the thrust-receiving member 9 and others on the inner surface are removed, a concave portion is left formed on the inner surface between the side rings 5 and 5 and remains in the main region in the thickness of the side rings 5 and 5 on both sides.

Figure 5:
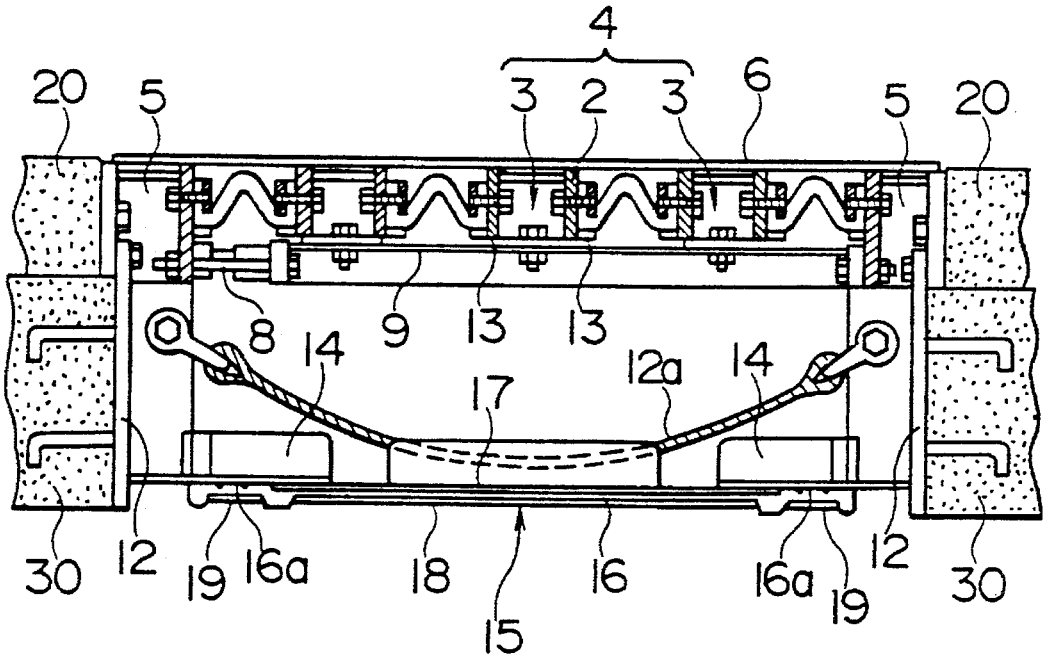
FIG. 5 is a cross-sectional drawing of the flexible segment of the present invention in one secondary coating state.
Figure 6:
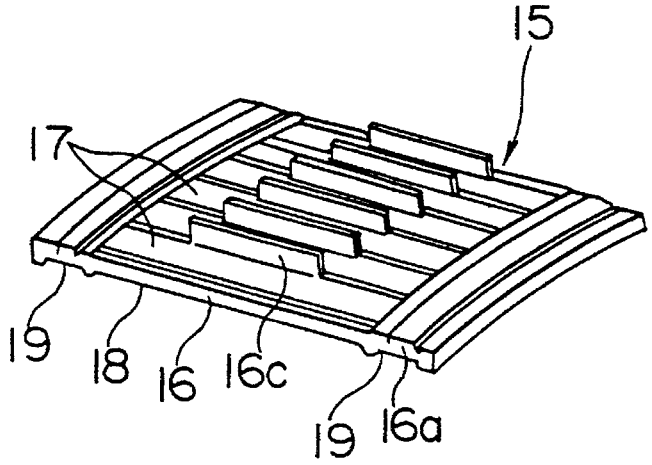
FIG. 6 is a drawing of a portion of the secondary watertight band for the flexible segment of the present invention in a secondary coating state, as viewed obliquely from the outer surface side.
Figure 7:
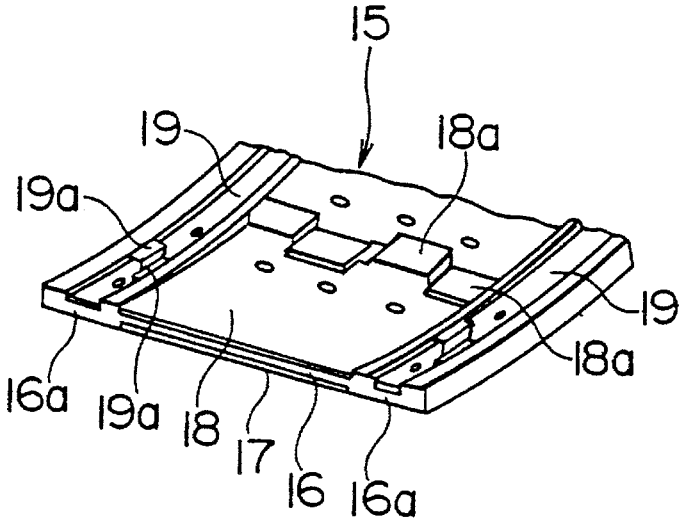
FIG. 7 is a drawing of a portion of the secondary watertight band where additional pieces are connected.

The thrust-receiving bolt 8 is removed in the above manner, or alternatively, is left connected. Then, as shown separately in FIG. 5, the secondary coating frames 12 are installed on the inner side of the side rings 5. These secondary coating frames 12 and 12 are connected together with a connection material 12*a* such as wire rope. A seal ring 14 is installed to each of the frames 12 and 12. A secondary watertight band 15 such as shown in FIGS. 6 and 7 is installed between these frames 12 and 12.

The secondary watertight band 15 is formed by arranging additional pieces 17 in a row in the axial direction on the outer surface of the seal member 16 at both ends of which are formed seal portions 16*a*. An additional piece 17 includes a reinforcement 16*c* formed with a cross-sectional letter "L" shape. The band also includes additional plates 18 and 19 which are installed in curved form on the inner surface along the circumferential direction. At the respective ends of the additional plates 18 and 19, pawls 18*a* and 19*a* are provided which engage with each other. With the resilience of these additional plates 18 and 19, the sealing member 16 is pressed against the seal rings 14. The additional plates 19 provide good sealing with the sealing portions 16*a*.

Figure 8:
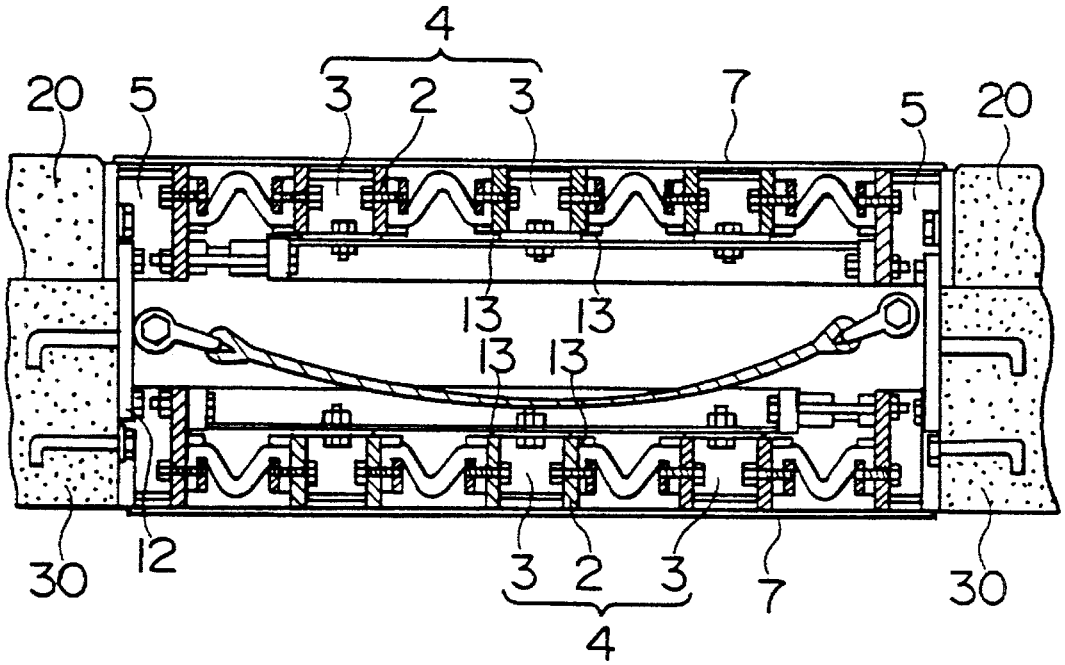
FIG. 8 is a cross-sectional drawing of another embodiment of the present invention in a secondary coating state, similar to FIG. 3.

In the present invention, said flexible portion 4 may also be installed in an inverted state between said secondary coating frames 12 and 12 as shown separately in FIG. 8. More specifically, inside the skin-plate 7 located on the the inner periphery side, the flexible portion 4 may be provided in a state inverted in relation to the flexible portion located on the outer periphery side. With such a configuration, it is obvious that substantial flexibility may be obtained with the flexible segment portion after secondary coating.

On the inner periphery side of the general segments 20 located on both sides of the secondary coating frames 12 and 12 provided as described above, secondary coating concrete 30 is applied as shown in FIG. 8 to complete the secondary application. Appropriate flexible action is attained from the flexible portion 4 between the side rings 5 and 5 where the thrust-receiving member 9 has been removed, and sealing is retained at the flexible member 1. Also, secondary sealing is ensured between the seal member 16 and the seal rings 14.

Figure 9:
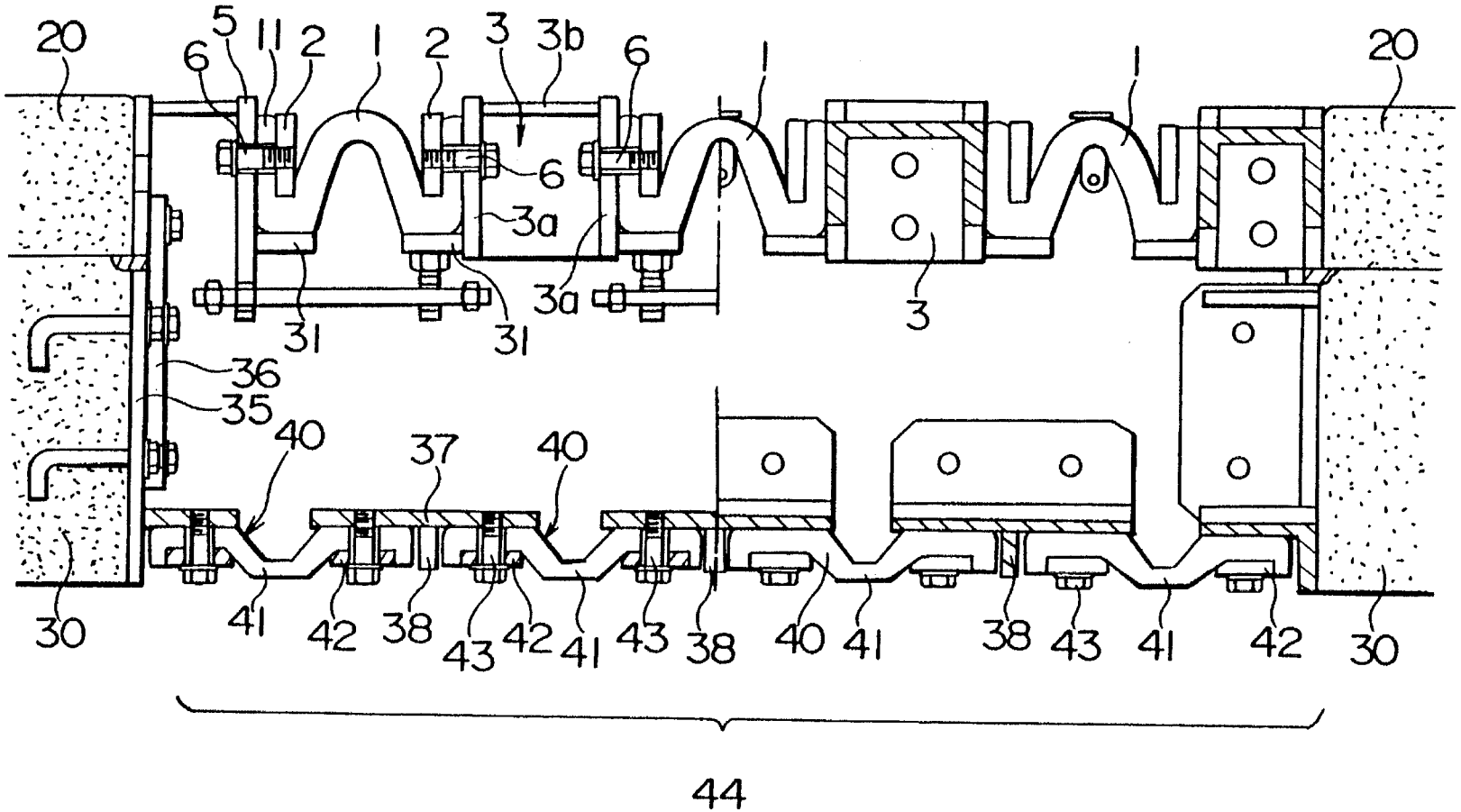
FIG. 9 is a cross-sectional drawing showing other examples of primary and secondary application segments of the present invention in a secondary coating state, similar to FIG. 3.
Figure 10:
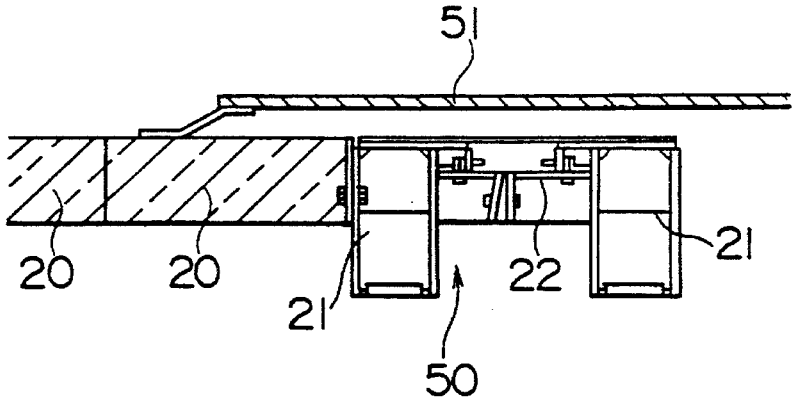
FIG. 10 (PRIOR ART)
FIG. 10 is a cross-sectional drawing showing the assembled state of a conventional flexible segment for the primary application.
Figure 11:
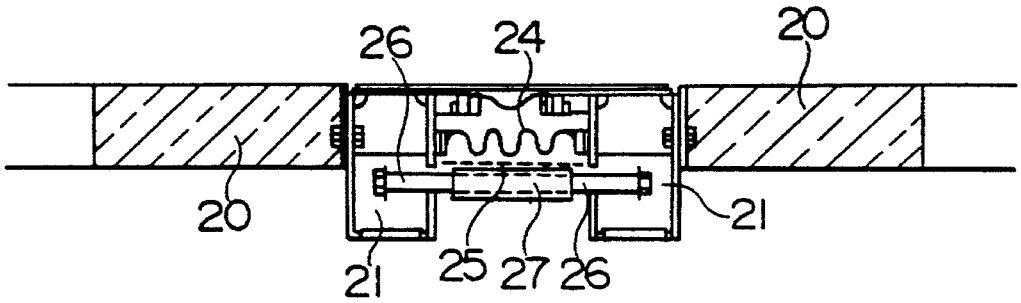
FIG. 11 (PRIOR ART)
FIG. 11 is a cross-sectional drawing showing the member installed state of a conventional flexible segment for the secondary application.
Figure 12:
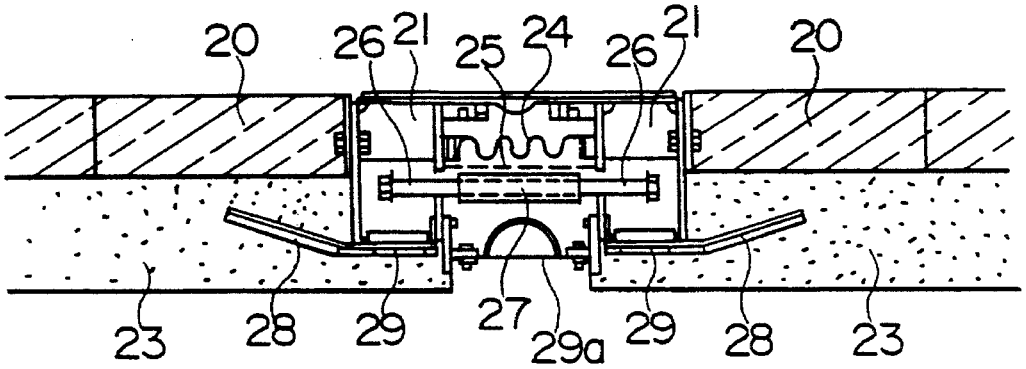
FIG. 12 (PRIOR ART)
FIG. 12 is a cross-sectional drawing showing the completed state of the secondary coating.

In the present invention, as shown separately in FIG. 9, instead of using the secondary coating frames 12 and 12 described above, second side ring members 35 and 35 having substantially the same width as the thickness of secondary coating concrete 30 provided inside said primary application segment 20 may be connected to said first side ring members with the connection plates 36, and a secondary application segment 44 may be formed between the second side ring members 35 and 35. The secondary application segment 44 consists of several plate-shaped second connection ring members 37 and second flexible members 40 having bendable portions 41 formed in the middle.

In the middle of said plate-shaped second connection member 37 a projection 38 is formed which accepts and supports an end of said second flexible member 40. An end of said second flexible member 40 is set against the projection 38 and the plate-shaped second connection member 37 as shown in FIG. 9 and secured with the retainer plate 42 and the bolt 43.

By forming the secondary application segment 44 such as shown in FIG. 9 inside the primary application segment, it is obvious that appropriate flatness is achieved with the plate-shaped second connection members 37 at the secondary application segment 44, and at the same time, considerable flexibility may be obtained with the bendable portions 41 of the second flexible members 40 after the secondary application, similarly to the primary application segment.

As an example, with the flexible segment of the present invention shown in FIG. 4, having an outer diameter of 2,750 mm, inner diameter of 2,500 mm, and a width of 900 mm, the water pressure resistance withstood an inner/outer pressure of 2 kgf/cm$^2$ under conditions of an expansion/contraction amount of +100 mm, a bent angle of 4 degrees, and an eccentricity of 100 mm. This sufficiently conforms to the setting conditions required of this kind of segment.

The characteristics described above also apply to the secondary application segment 44 shown in FIG. 9.

With the flexible segment of the present invention shown in FIG. 8, the expansion/contraction amount, bent angle and eccentricity are all double and the water pressure resistance is the same as described above.

What is claimed is:

1. A shield tunneling method using flexible structural segments arranged adjacent to general non-flexible structural segments, comprising the steps of:

a) providing a flexible segment having:

first and second side members arranged opposite each other at opposite sides of said flexible segment, said side members having substantially the same thickness as the general structural segments;

a plurality of flexible members each having an inverted V-shaped bend portion in respective middle portions thereof, said flexible members being connected adjacent to each other in side-by-side relation between said first and second side members, said flexible members each having apexes of their respective V-shaped bend portions directed in an outer peripheral direction, and said flexible members having parallel joint end faces at respective opposite sides of the inverted V-shaped bend portions thereof;

a plurality of connection ring members, each ring member being connected between a pair of adjacent flexible members such that said flexible members are alternately connected to each other via respective connection ring members;

said first and second side members, said flexible members and said ring members, when connected together, comprising a flexible portion;

a skin-plate provided on an outer periphery side of the flexible portion, said skin-plate extending over said flexible members and said ring members, and said skin-plate extending between said side members; and a removable thrust-receiving member arranged on an interior side of said flexible portion for receiving a force to propel the flexible segment into a site in a same manner as a general structural segment;

b) propelling a flexible segment into a construction site adjacent to a previously propelled general structural segment;

c) removing said thrust-receiving member after said flexible segment is propelled into the construction site so that said flexible portion remains in the construction site;

d) thereafter installing a secondary coating frame on the interior side of said flexible portion;

e) installing seal rings to said secondary coating frame; and f) installing a secondary watertight band on the interior side of said flexible portion and between said seal rings.

2. A shield tunneling method using flexible structural segments arranged adjacent to general non-flexible structural segments, comprising the steps of:

a) providing a primary flexible segment having:

first and second primary side members arranged opposite each other at opposite sides of said flexible segment, said primary side members having substantially the same thickness as the general structural segments;

a plurality of flexible members each having an inverted V-shaped bend portion in respective middle portions thereof, said flexible members being connected adjacent to each other in side-by-side relation between said first and second primary side members, said flexible members each having apexes of their respective V-shaped bend portions directed in an outer peripheral direction, and said flexible members having parallel folded-back joint end faces at respective opposite sides of the inverted V-shaped bend portions thereof;

a plurality of first connection ring members, each first ring member being connected between joint end faces of a pair of adjacent flexible members such that said flexible members are alternately connected to each other via respective connection ring members;

said first and second side members, said flexible members and said ring members, when connected together, comprising a flexible portion; and a removable thrust-receiving member connected to said flexible portion for receiving a force to propel the flexible segment into a site in a same manner as a general structural segment;

b) propelling the primary flexible segment into a construction site adjacent to a previously propelled general structural segment;

c) removing said thrust-receiving member after said primary flexible segment is propelled into the construction site so that said flexible portion remains in the construction site;

d) thereafter installing a secondary coating frame on the interior side of said flexible portion;

e) installing a secondary flexible segment at the interior side of said primary flexible segment, said secondary flexible segment comprising:

secondary side members having substantially the same width as the thickness of the secondary flexible segment provided at the interior side of said primary flexible segment, said secondary side members being connected to said primary side members; and second connection ring members and second flexible members having bendable portions in middle portions thereof, said second connection ring members and said second flexible members being alternately connected to each other to form a secondary flexible portion which is connected between said secondary side members.

3. The method of claim 2, comprising forming said second flexible members to each comprise a flexible member having a V-shaped bend portion in a middle portion thereof.

4. The method of claim 3, wherein said V-shaped bend portions of said-second flexible members have apexes directed in an inner peripheral direction of said flexible structural segment.

5. The method of claim 2, wherein said joint end faces of said flexible members of said primary flexible segment are formed to have folded-back portions of said V-shaped bend portions, and wherein said joint end faces have substantially the same thickness as said V-shaped bend portions.

6. The method of claim 1, wherein said joint end faces of said flexible members comprise folded-back portions of said V-shaped bend portions, and wherein said joint end faces are formed to have substantially the same thickness as said V-shaped bend portions.

7. The method of claim 1, comprising bolting said thrust-receiving member to said first and second side members so as to be removable from said first and second side members.

8. The method of claim 2, comprising bolting said thrust-receiving member to said first and second primary side members so as to be removable from said primary side members.

9. The method of claim 1, comprising integrally forming said joint end faces with said V-shaped bend portions of each of said plurality of flexible members.

10. The method of claim 2, comprising integrally forming said joint end faces of said flexible members of said primary flexible segment with said V-shaped bend portions of each of said plurality of flexible members of said primary flexible segment.

11. The method of claim 2, comprising integrally joining said joint end faces of said flexible members of said secondary flexible segment with said V-shaped bend portions of each of said plurality of flexible members of said secondary flexible segment.

12. The method of claim 1, wherein said V-shaped bend portions of said flexible members are arranged in said flexible segment so as to be in a compression state whereby said V-shaped bend portion has a smaller dimension in a width direction than the corresponding dimension when it is formed, such that when an elongation force is absorbed by said flexible segment, substantially no tensile force is exerted on said V-shaped bend portions.

13. The method of claim 2, wherein said V-shaped bend portions of said flexible members of said primary and secondary flexible segments are arranged in said flexible segments so as to be in a compression state whereby said V-shaped bend portions have a smaller dimension in a width direction than the corresponding dimension when they are formed, such that when an elongation force is absorbed by said flexible segments, substantially no tensile force is exerted on said V-shaped bend portions.

14. The method of claim 1, wherein said joint end faces respectively are made to have a width which is from 50 to 70% of the width of the first and second side members.

15. The method of claim 2, wherein said joint end faces respectively are made to have a width which is from 50 to 70% of the width of the first and second primary side members.

16. The method of claim 2, comprising mounting a skin-plate on an outer periphery side of said flexible portion before said flexible segment is propelled into a site, said skin-plate extending over said flexible members and said ring members, and said skin-plate extending between said side members.

17. A flexible structural segment for use in construction, comprising:

first and second side members arranged opposite each other at opposite sides of said flexible segment;

a plurality of flexible members each having an inverted V-shaped bend portion in respective middle portions thereof, said flexible members being connected adjacent to each other in side-by-side relation between said first and second side members, said flexible members each having apexes of their respective V-shaped bend portions directed in an outer peripheral direction, and said flexible members having parallel joint end faces at respective opposite sides of the inverted V-shaped bend portions thereof;

a plurality of connection ring members, each ring member being connected between a pair of adjacent flexible members such that said flexible members are alternately connected to each other via respective connection ring members;

said first and second side members, said flexible members and said ring members, when connected together, comprising a flexible portion;

a skin-plate provided on an outer periphery side of the flexible portion, said skin-plate extending over said flexible members and said ring members, and said skin-plate extending between said side members; and a removable thrust-receiving member arranged on an interior side of said flexible portion for receiving a force to propel the flexible segment into a site in a same manner as a general structural segment;

said thrust-receiving member being removed from said flexible portion after said flexible segment is propelled into the construction site;

a secondary coating frame mounted on the interior side of said flexible portion after removal of said thrust-receiving member;

seal rings connected to said secondary coating frame; and a secondary watertight band mounted on the interior side of said flexible portion and connected between said seal rings.

18. A flexible structural segment for use in construction, comprising:

(a) a primary flexible segment comprising:

first and second primary side members arranged opposite each other at opposite sides of said primary flexible segment;

a plurality of flexible members each having an inverted V-shaped bend portion in respective middle portions thereof, said flexible members being connected adjacent to each other in side-by-side relation between said first and second primary side members, said flexible members each having apexes of their respective V-shaped bend portions directed in an outer peripheral direction, and said flexible members having parallel joint end faces at respective opposite sides of the inverted V-shaped bend portions thereof;

a plurality of connection ring members, each ring member being connected between a pair of adjacent flexible members such that said flexible members are alternately connected to each other via respective connection ring members;

said first and second primary side members, said flexible members and said ring members, when connected together, comprising a flexible portion;

a skin-plate provided on an outer periphery side of the flexible portion, said skin-plate extending over said flexible members and said ring members, and said skin-plate extending between said side members; and a removable thrust-receiving member arranged on an interior side of said flexible portion for receiving a force to propel the flexible segment into a site in a same manner as a general structural segment, said thrust-receiving member being removable from said flexible portion after said primary flexible segment is propelled into the construction site; and (b) a secondary flexible segment at the interior side of said primary flexible segment, said secondary flexible segment comprising:

secondary side members having substantially the same width as the thickness of the secondary flexible segment provided at the interior side of said primary flexible segment, said secondary side members being connected to respective ones of said primary side members; and second connection ring members and second flexible members having bendable portions in middle portions thereof, said second connection ring members and said second flexible members being alternately connected to each other to form a secondary flexible portion which is connected between said secondary side members.

19. The flexible structural segment of claim 17, wherein said thrust-receiving member is bolted to said first and second side members so as to be removable from said first and second side members.

20. The flexible structural segment of claim 18, wherein said thrust-receiving member is bolted to said first and second primary side members so as to be removable from said primary side members.

21. The flexible structural segment of claim 17, wherein said joint end faces are integrally formed with said V-shaped bend portions of each of said plurality of flexible members.

22. The flexible structural segment of claim 18, wherein said joint end faces of said flexible members of said primary flexible segment are integrally formed with said V-shaped bend portions of each of said plurality of flexible members of said primary flexible segment.

23. The flexible structural segment of claim 18, wherein said joint end faces of said flexible members of said secondary flexible segment are integrally formed with said V-shaped bend portions of each of said plurality of flexible members of said secondary flexible segment.

24. The flexible structural segment of claim 17, wherein said V-shaped bend portions of said flexible members are arranged in said flexible segment so as to be in a compression state whereby said V-shaped bend portion has a smaller dimension in a width direction than the corresponding dimension when it is formed, such that when an elongation force is absorbed by said flexible segment, substantially no tensile force is exerted on said V-shaped bend portions.

25. The flexible structural segment of claim 18, wherein said V-shaped bend portions of said flexible members of said primary and secondary flexible segments are arranged in said flexible segments so as to be in a compression state whereby said V-shaped bend portions have a smaller dimension in a width direction than the corresponding dimension when they are formed, such that when an elongation force is absorbed by said flexible segments, substantially no tensile force is exerted on said V-shaped bend portions.

26. The flexible structural segment of claim 17, wherein said joint end faces respectively have a width which is from 50 to 70% of the width of the first and second side members.

27. The flexible structural segment of claim 18, wherein said joint end faces respectively have a width which is from 50 to 70% of the width of the first and second primary side members.

* * * * *